US009592599B2

(12) United States Patent
Pauze

(10) Patent No.: US 9,592,599 B2
(45) Date of Patent: Mar. 14, 2017

(54) DRYWALL TOOL AND METHOD OF USING THE SAME

(76) Inventor: Adam Pauze, Aurora (CA)

( * ) Notice: Subject to any disclaimer, the term of this patent is extended or adjusted under 35 U.S.C. 154(b) by 911 days.

(21) Appl. No.: 13/489,813

(22) Filed: Jun. 6, 2012

(65) Prior Publication Data

US 2013/0326821 A1 Dec. 12, 2013

(51) Int. Cl.

| | |
|---|---|
| ***B25F 1/00*** | (2006.01) |
| ***B26B 11/00*** | (2006.01) |
| ***B26B 29/02*** | (2006.01) |
| ***B26B 29/06*** | (2006.01) |

(52) U.S. Cl.

CPC ..... *B25F 1/00* (2013.01); *B26B 11/00* (2013.01); *B26B 29/02* (2013.01); *B26B 29/06* (2013.01)

(58) Field of Classification Search

CPC ..... G01B 3/1041; G01B 3/1084; G01B 3/10; G01B 3/1056; G01B 3/1071; G01B 2003/1076; G01B 2003/1079; B26B 5/001; B26B 11/00; B26B 29/02; B26B 29/06; B26B 29/11; B25F 1/00

USPC ..... 7/163, 158, 164, 167, 105, 199; 33/1 R, 33/18.1, 32.1, 32.5, 403, 404, 700, 755, 33/758, 574, 577

See application file for complete search history.

(56) References Cited

U.S. PATENT DOCUMENTS 720,507 A * 2/1903 Van Horn ..... B43L 9/02 33/27.02
2,473,189 A * 6/1949 Baker ..... C03B 33/12 33/42
2,952,025 A * 9/1960 Johnson ..... B26B 29/06 30/123
4,296,554 A * 10/1981 Hammerstrom ..... 33/32.5
4,756,085 A 7/1988 Lebessis
4,827,622 A * 5/1989 Makar ..... G01B 3/1071 33/770
4,949,462 A * 8/1990 Spencer ..... B26B 29/06 30/293
4,976,037 A * 12/1990 Hines ..... B26B 11/00 33/27.03
D321,637 S 11/1991 Chan
5,099,578 A * 3/1992 Jan ..... B26B 5/001 30/162
5,154,006 A * 10/1992 Wooster ..... B43L 9/045 33/668
5,172,486 A * 12/1992 Waldherr ..... B43L 9/045 33/27.03

(Continued)

*Primary Examiner* — Hadi Shakeri
(74) *Attorney, Agent, or Firm* — Sand & Sebolt

(57) ABSTRACT

A tool and method for measuring, marking and/or scoring drywall sheets. The tool includes a housing having front and rear housing sections forming an internal chamber; a spool rotatably mounted within the chamber; a flexible tape stored on the spool and expandable and retractable from the housing; a brake mechanism mounted on the housing and engageable to maintain the tape in an extended position; a guide mounted on a second end of the tape; and a contact device extending from the housing for marking and/or scoring the surface of the sheet. The guide is placed in abutting contact with an edge of the drywall sheet and the contact device is positioned on the exterior surface thereof. The housing is moved across the exterior surface while the guide remains in abutting contact with the edge, and the contact device marks or scores the surface as the housing is moved thereover.

30 Claims, 13 Drawing Sheets

(56) References Cited

U.S. PATENT DOCUMENTS 5,295,308 A * 3/1994 Stevens ..... G01B 3/1071 33/42
5,426,802 A * 6/1995 Greenwood ..... B26B 29/06 7/163
5,430,952 A * 7/1995 Betts ..... 33/760
5,459,647 A 10/1995 Betts
D394,792 S 6/1998 Bourque
5,768,797 A * 6/1998 Trevino ..... 33/761
D402,525 S 12/1998 Hsu
5,842,284 A * 12/1998 Goldman ..... 33/760
5,966,820 A * 10/1999 Cornacchio ..... B26B 29/06 30/286
D420,560 S 2/2000 Hepworth
6,223,443 B1 * 5/2001 Jacobs ..... B43L 9/04 33/27.03
6,454,427 B1 * 9/2002 Chen ..... B26B 5/001 16/111.1
6,467,174 B1 10/2002 Kotori
6,497,050 B1 * 12/2002 Ricalde ..... B25H 7/04 33/668
6,612,035 B2 9/2003 Brown et al.
6,880,260 B2 * 4/2005 Baida ..... B25C 3/008 33/668
6,912,799 B1 * 7/2005 Smith ..... B25H 7/04 33/27.031
6,938,354 B2 * 9/2005 Worthington ..... C07K 16/40 33/668
7,055,260 B1 * 6/2006 Hoffman ..... G01B 3/1082 33/758
7,131,215 B2 * 11/2006 Kang ..... G01B 3/1041 33/760
7,269,913 B2 * 9/2007 Holevas ..... G01B 3/1084 33/668
7,412,794 B2 * 8/2008 Smith ..... A01K 87/08 33/511
D630,082 S 1/2011 Bourque
8,819,954 B1 * 9/2014 Fernandez ..... G01B 3/1084 33/42
2003/0066137 A1 * 4/2003 Johnson et al. ..... 7/160
2005/0217032 A1 * 10/2005 Bruggisser ..... B25C 5/0214 7/119
2006/0265812 A1 * 11/2006 Balliette ..... B25F 1/00 7/164
2008/0250664 A1 * 10/2008 Wise ..... 33/770
2008/0256816 A1 * 10/2008 Cosentino ..... B26B 5/001 33/760
2009/0249636 A1 * 10/2009 Reda et al. ..... 33/760

* cited by examiner

DRYWALL TOOL AND METHOD OF USING THE SAME

BACKGROUND OF THE INVENTION

Technical Field

This application relates generally to construction tools. More particularly, this invention relates to tools used for installation of drywall. Specifically, this invention relates to drywall tool and method of using the same, where the tool includes an extendable tape having a guide at one end and a contact device that is able to mark or score the exterior surface of the sheet while the tool is moved across the surface and the guide is kept in abutting engagement with the edge of the drywall sheet, so as to maintain a constant distance between the edge and the contact device.

Background Information

Professional drywall installers use a tape measure and a utility knife to install drywall. They will first measure the required opening and note measurements. Then they will move to the stack of drywall that is leaning substantially vertically against a nearby wall. With the previously noted measurements they will pull the tape out so that the desired number is just exiting the tape measure and push the tape lock. With the tape body in one hand and the utility knife in the other hand, they grab the end of the tape with the utility knife hand and then place the body of the tape measure on the edge of the drywall panel. While holding the knife and tape end in the other hand on the drywall, the installer will move along the entire panel scoring the drywall board. This requires a great deal of skill as the tape measure body is not intended to slide sideways along the edge of a sheet of drywall. Holding the tape end and the utility knife in one hand is tricky, inaccurate and potentially dangerous in that the installer may cut himself with the utility knife. Next, the installer will pull the board a few inches away from the wall and impact the opposite side of the scored region with their hand, foot or knee to break the board at the score line.

There is therefore a need in the art for a tool that simplifies the marking and cutting operation.

BRIEF SUMMARY OF THE INVENTION

The drywall tool in accordance with the present invention saves time and potentially reduces the number of injuries which may occur in the workplace. The drywall tool includes a tape which may be extended outwardly from the tool to measure and mark the required opening. The tool includes a locking mechanism which locks the tape in the extended position so that the drywall sheet may be measured and marked without the installer having to repeatedly read numbers on the tape as they mark and score the sheet of drywall. A knife extending outwardly from the tool is engaged with the drywall when the tape is in the correct position and an end thereof is positioned adjacent the edge of the drywall panel. The installer can then run the knife along the panel while maintaining the end of the tape in abutting contact with the edge of the panel. This allows the installer to easily, accurately and safely score the drywall panel. The drywall tool in accordance with the present invention also includes a marking implement that extends outwardly therefrom and which may be used to mark the drywall panel instead of the knife.

A tool and method for measuring, marking and/or scoring drywall sheets is disclosed. The tool includes a housing having front and rear housing sections forming an internal chamber; a spool rotatably mounted within the chamber; a flexible tape stored on the spool and expandable and retractable from the housing; a brake mechanism mounted on the housing and engageable to maintain the tape in an extended position; a guide mounted on a second end of the tape; and a contact device extending from the housing for marking and/or scoring the surface of the sheet. The guide is placed in abutting contact with an edge of the drywall sheet and the contact device is positioned on the exterior surface thereof. The housing is moved across the exterior surface while the guide remains in abutting contact with the edge, and the contact device marks or scores the surface as the housing is moved thereover.

The method of using a drywall tool in accordance with the present invention for measuring an opening to be filled with a sheet of drywall and marking or scoring the sheet of drywall to match the opening with said tool includes the steps of:

placing a tape guide provided on an end of a flexible tape contained on a spool rotatably mounted within the tool on one edge of the opening;

retaining the tape guide against the edge;

moving the tool so that a contact device on the tool aligns with an opposite edge of the opening;

drawing a length of the flexible tape off the spool as the tool is moved; and engaging a brake mechanism to lock the flexible tape against further movement relative to the spool.

The method further comprises the steps of:

placing the tape guide in abutting contact with an edge of the sheet of drywall;

placing the contact device on the tool against an exterior surface of the sheet of drywall so that the length of the flexible tape extends between the edge of the sheet and the contact device;

moving the tool parallel to the edge of the sheet and across the exterior surface;

marking or scoring the exterior surface of the sheet with the contact device; and maintaining the tape guide against the edge of the sheet during the marking or scoring operation.

BRIEF DESCRIPTION OF THE SEVERAL VIEWS OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

Similar numbers refer to similar parts throughout the drawings.

DETAILED DESCRIPTION OF THE INVENTION

Figure 1:
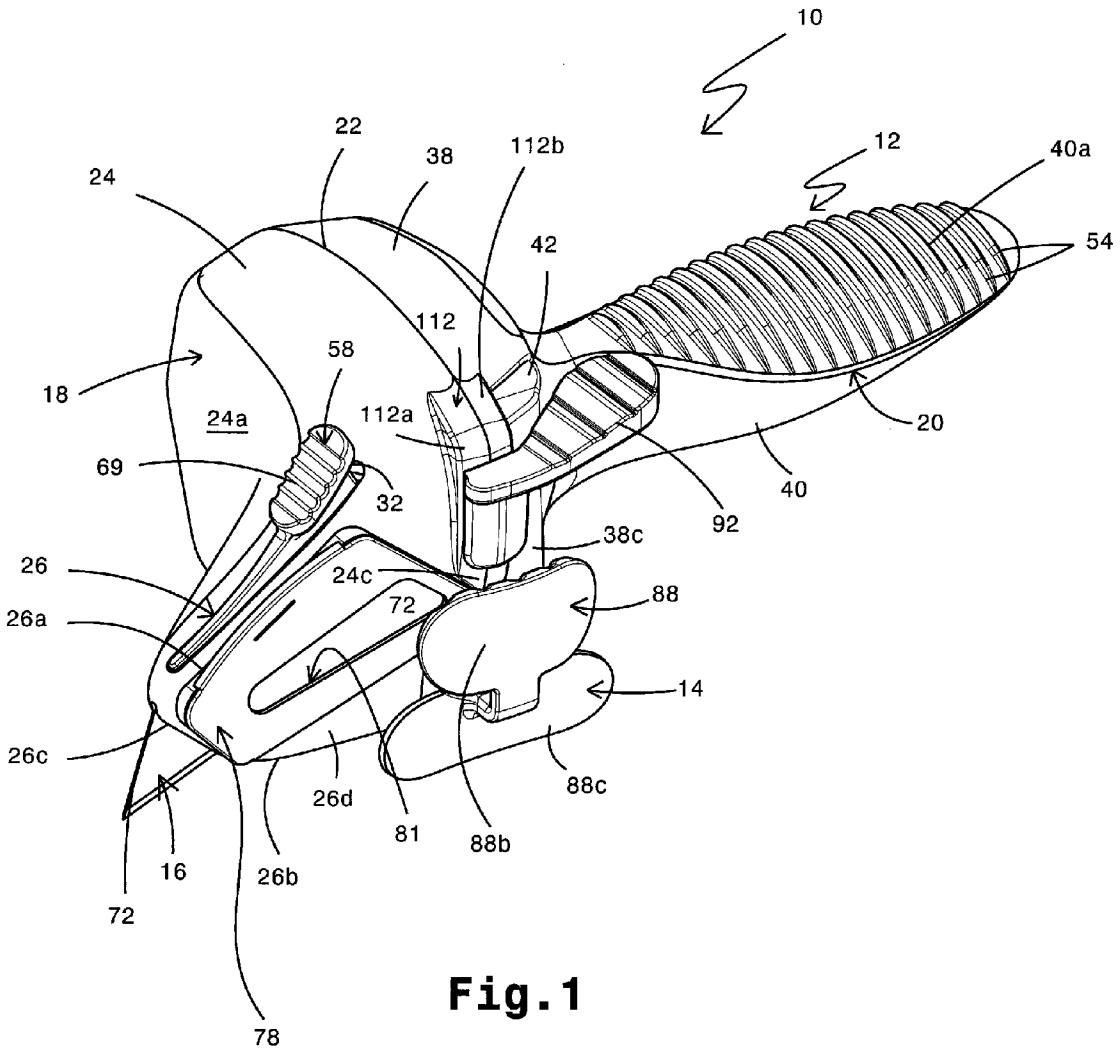
FIG. 1 is a perspective view of a drywall tool in accordance with the present invention, shown in a first position where the tape is fully retracted into the device and the edge of the knife extends outwardly therefrom.
Figure 2:
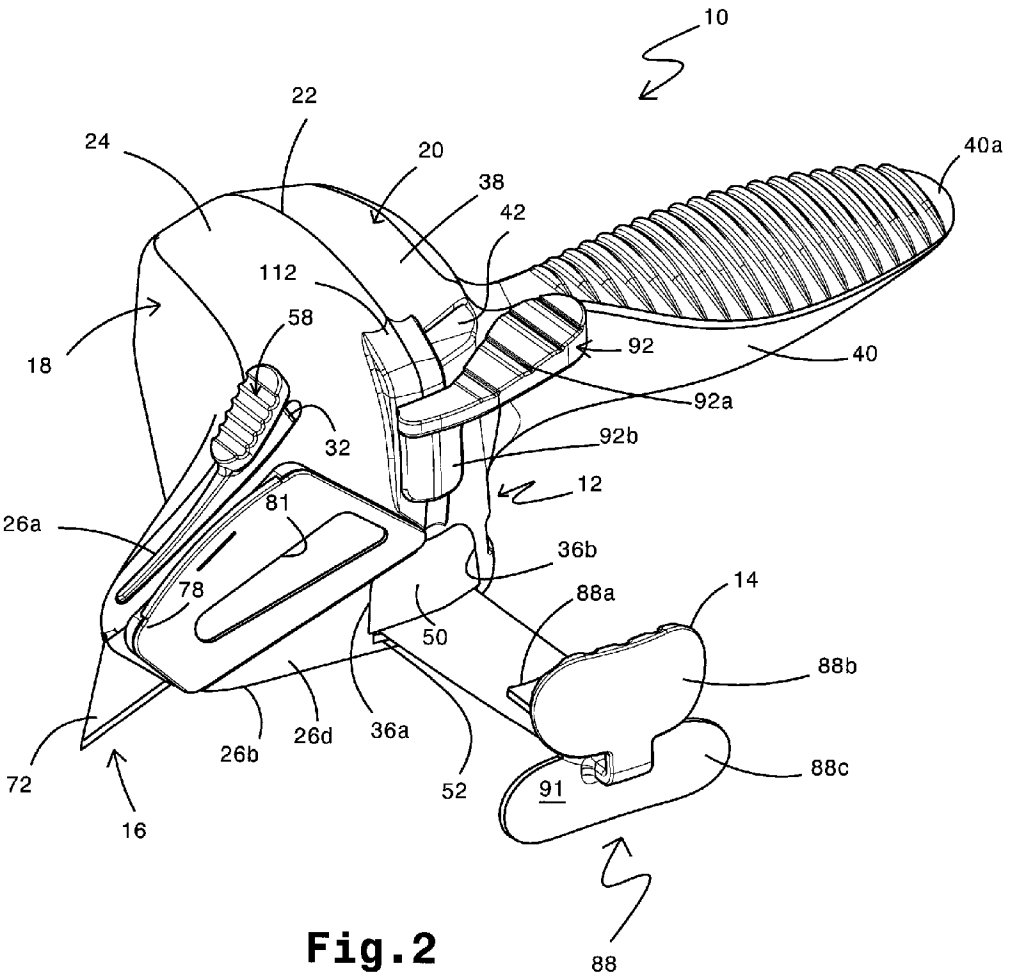
FIG. 2 is a perspective view of the drywall tool of FIG. 1 showing the tape partially extended from the tool and showing the edge of the knife extending outwardly from the tool.

Referring to FIGS. 1-10 there is shown a drywall tool in accordance with the present invention and generally indicated at 10. Tool 10 comprises a housing 12 having a tape assembly 14 and a knife assembly 16 engaged therewith.

FIGS. 1-6 show that housing 12 comprises a front housing section 18 and a rear housing section 20 that are joined together along a joint 22. Both of front and rear housing sections 18, 20 preferably are made from a rigid plastic but they may also be made from any other suitable material such as metal. Front housing section 18 includes a first region 24 and a knife casing 26.

First region 24 preferably is generally square in cross-section shape and knife casing 26 is generally triangular over its length from where it originates in first region 24 to its outermost end. First region 24 has a front end 24*a*, a rear end 24*b*, and a peripheral wall 24*c* extending between the front and rear ends 24*a*, 24*b*. Front end, rear end and peripheral wall 24*a*-24*c* are integrally. Rear end 24*b* includes a lip that is of substantially the same shape as peripheral wall 24*c* but is recessed inwardly relative thereto. Peripheral wall 24*c* includes a rear edge 24*d* disposed proximate the lip. Rear edge 24*d* is configured and positioned to be brought into abutting contact with a portion of rear housing section 20 to form joint 22.

Front housing section 18 defines a first part 28*a* of a chamber 28 defined in housing 12. The first part 28*a* of chamber 28 is bounded and defined by front end, rear end, and peripheral wall 24*a*-24*c*. A first part 30*a* of an axle 30 extends into chamber 28 from an interior surface of front end 24*a*. First part 30*a* of axle 30 preferably is disposed generally at right angles to the interior surface of front end 24*a* and projects for a distance beyond rear end 24*b*. The purpose of axle 30 will be later described herein.

In accordance with a specific feature of the present invention, the knife casing 26 extends outwardly from front end 24*a* of first region 24. Preferably, knife casing 26 is disposed adjacent one side of the front end 24*a* and is offset relative to the longitudinal axis "Y" (FIG. 4) of display tool 10. Knife casing 26 is oriented generally at right angles to front end 24*a* of front housing section 18. Knife casing 26 has a top 26*a*, a bottom 26*b*, a front 26*c*, a first side 26*d* and a second side 26*e*. A first aperture 32 is defined in top 26*a* of knife casing 26. A second aperture 34 (FIG. 8) is defined in a portion of front 26*c* and of bottom 26*b* of knife casing 26. First and second apertures 32, 34 are in communication with a cavity (not shown) defined within knife casing 26. This cavity preferably is additionally in communication with chamber 28.

Figure 9:
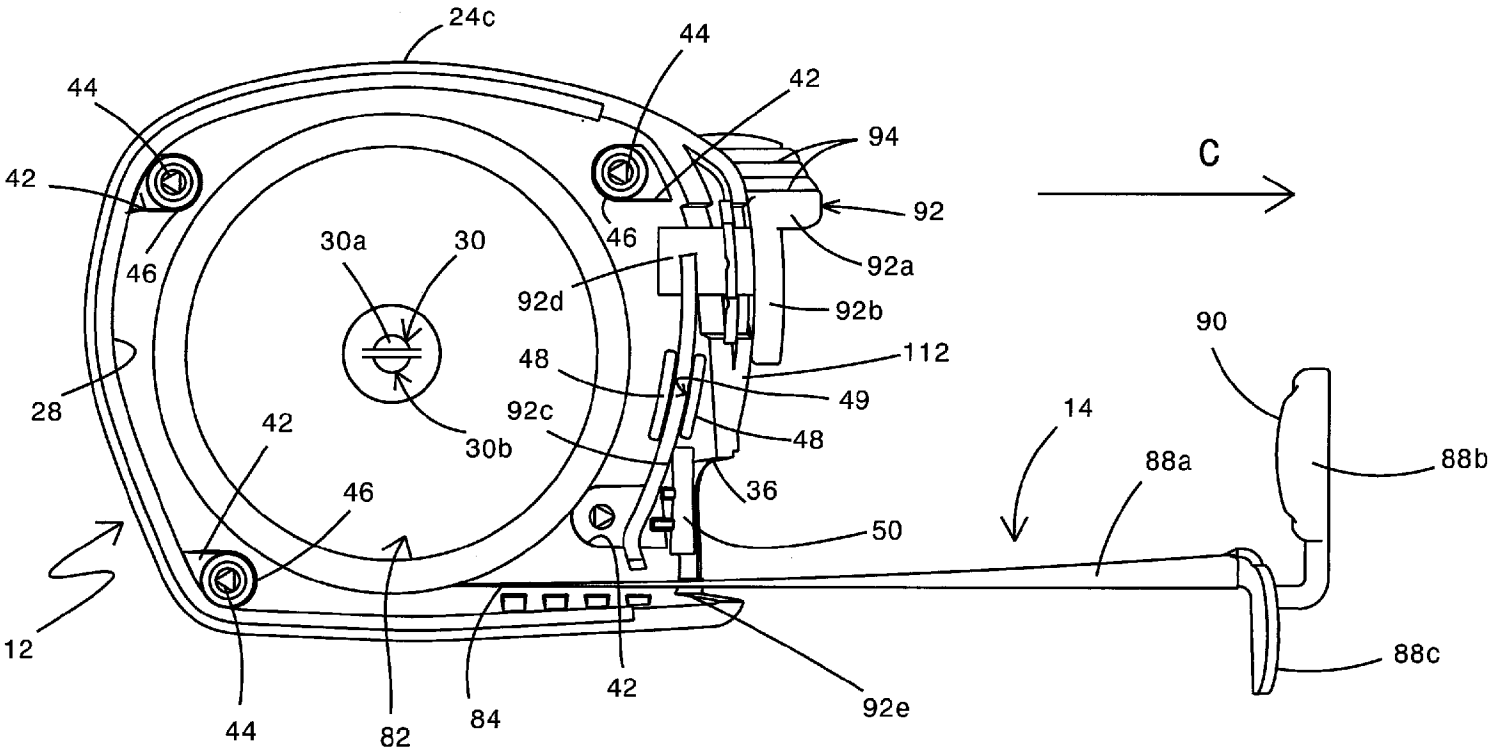
FIG. 9 is a cross-sectional front view of the tape dispenser showing the locking mechanism in a disengaged position.

Peripheral wall 24*c* of first housing section 18 further defines a first part 36*a* of an aperture 36 situated in a location adjacent to and rearwardly from first side 26*d* of knife casing 26 (FIG. 9). Aperture 36 is in communication with chamber 28 and the purpose thereof will be described later herein.

Figure 6:
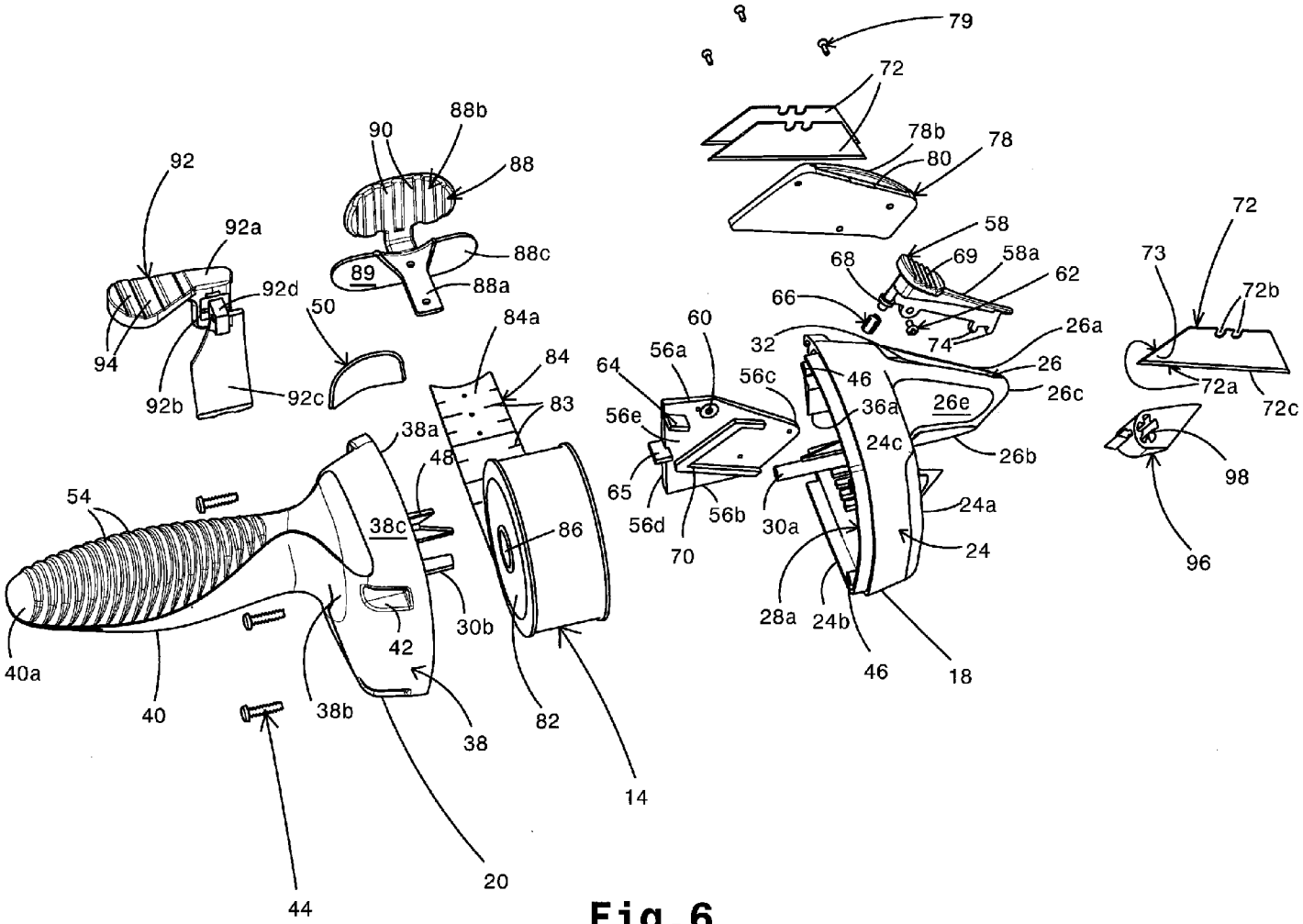
FIG. 6 is an exploded right side view thereof.

Rear housing section 20 of housing 12 is shown in greater detail in FIG. 6. Rear housing section 20 comprises a second region 38 and a handle 40. Second region 38 is substantially square in cross-sectional shape and is configured to be complementary to first region 24 of front housing section 20. It will be understood that first and second regions 24, 38 may have different cross-sectional shapes, such as both being generally circular, without departing from the scope of the present invention.

Second region 38 includes a front end 38*a*, a rear end 38*b*, and a peripheral wall 38*c*. Peripheral wall 38*c* is of a substantially identical shape and size as peripheral wall 24*c* of first region 38. Front end 38*a*, rear end 38*b*, and peripheral wall 38*c* of second region 38 bound and define a second part (not shown) of the chamber 28 in housing 12. Additionally, a second part 30*b* (FIG. 6) of an axle 30 extends forwardly from an interior surface of rear end 38*b* of second region 38 and outwardly beyond first end 38*a* thereof. First and second parts 30*a*, 30*b* of axle 30 are configured and oriented to be disposed adjacent each other when first and second regions 24, 38 are engaged and secured together.

Second region 38 further includes a pair of flanges 48 (FIGS. 6 and 9) which project forwardly from an interior surface of second region 38 and for a distance beyond front end 38*a* thereof. Flanges 48 are separated from each other by a gap 49 (FIG. 9) and the purpose of flanges 48 will be described later herein. Second region 38 further defines a second portion 36*b* of aperture 36 in a location that is aligned with first portion 36*a* defined in first region 24. A panel 50 is engaged in aperture 36 in such a way that a slot 52 is formed between a lower edge of panel 50 and portions of peripheral wall 24*c*/38*c*. Preferably, panel 50 is manufactured from a clear plastic.

Figure 5:
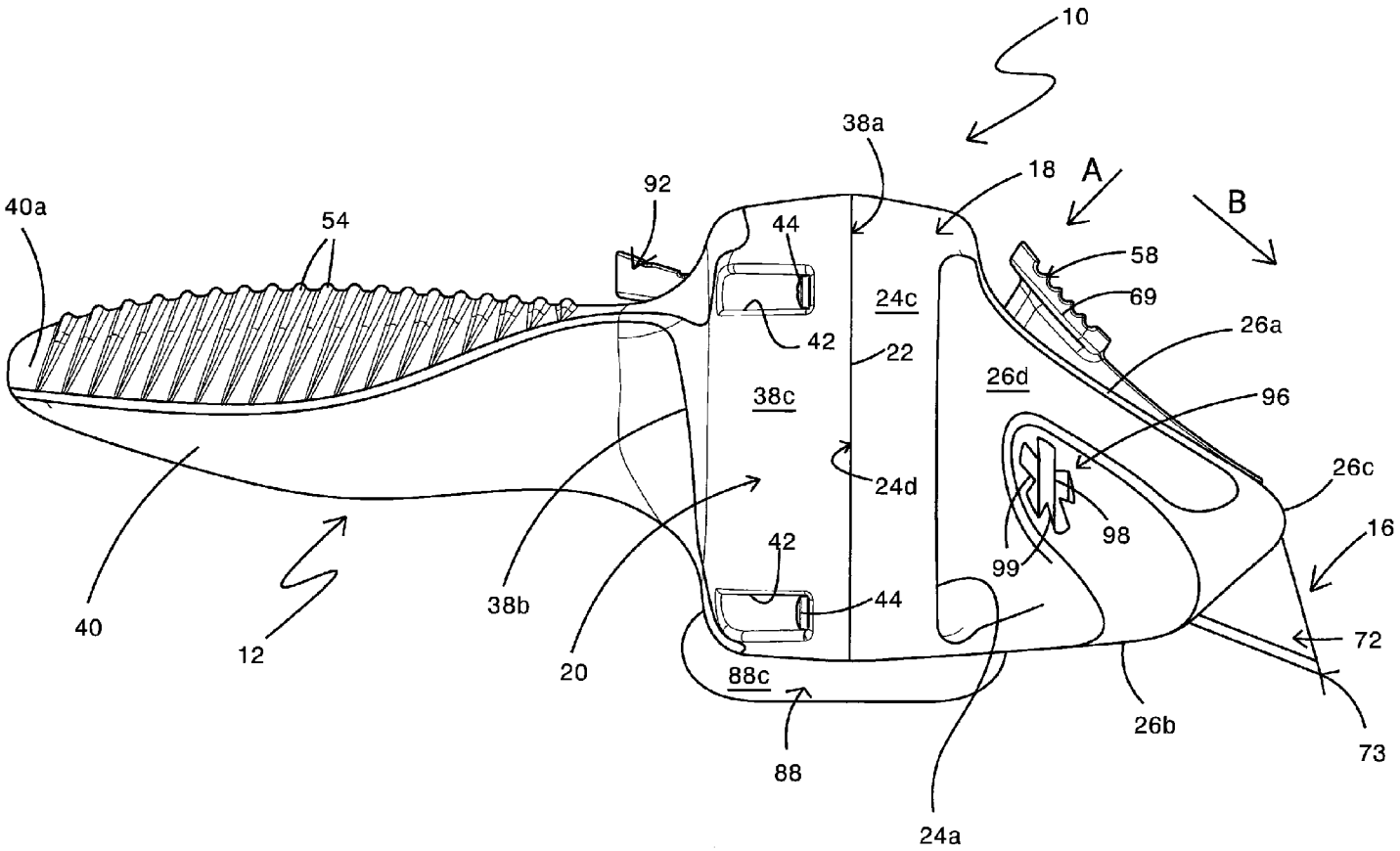
FIG. 5 is a right side view thereof.

When first and second regions 24, 38 are engaged with each other the rear end 24*b* of first region 24 is received into the second part of chamber 28 and front end 38*a* of second region 38 abuts the edge 24*d* of first region 24. As best seen in FIG. 5, peripheral wall 38*c* defines a plurality of recesses 42 therein that are oriented substantially at right angles to front end 38*a*. A fastener 44 is received through a hole (not shown) in each recess 42 and into an aligned hole (not shown) in a boss 46 which extends rearwardly from the interior surface of front end 24*a* of first region 24. Fasteners 44 secure first and second regions 24, 38 together.

Figure 3:
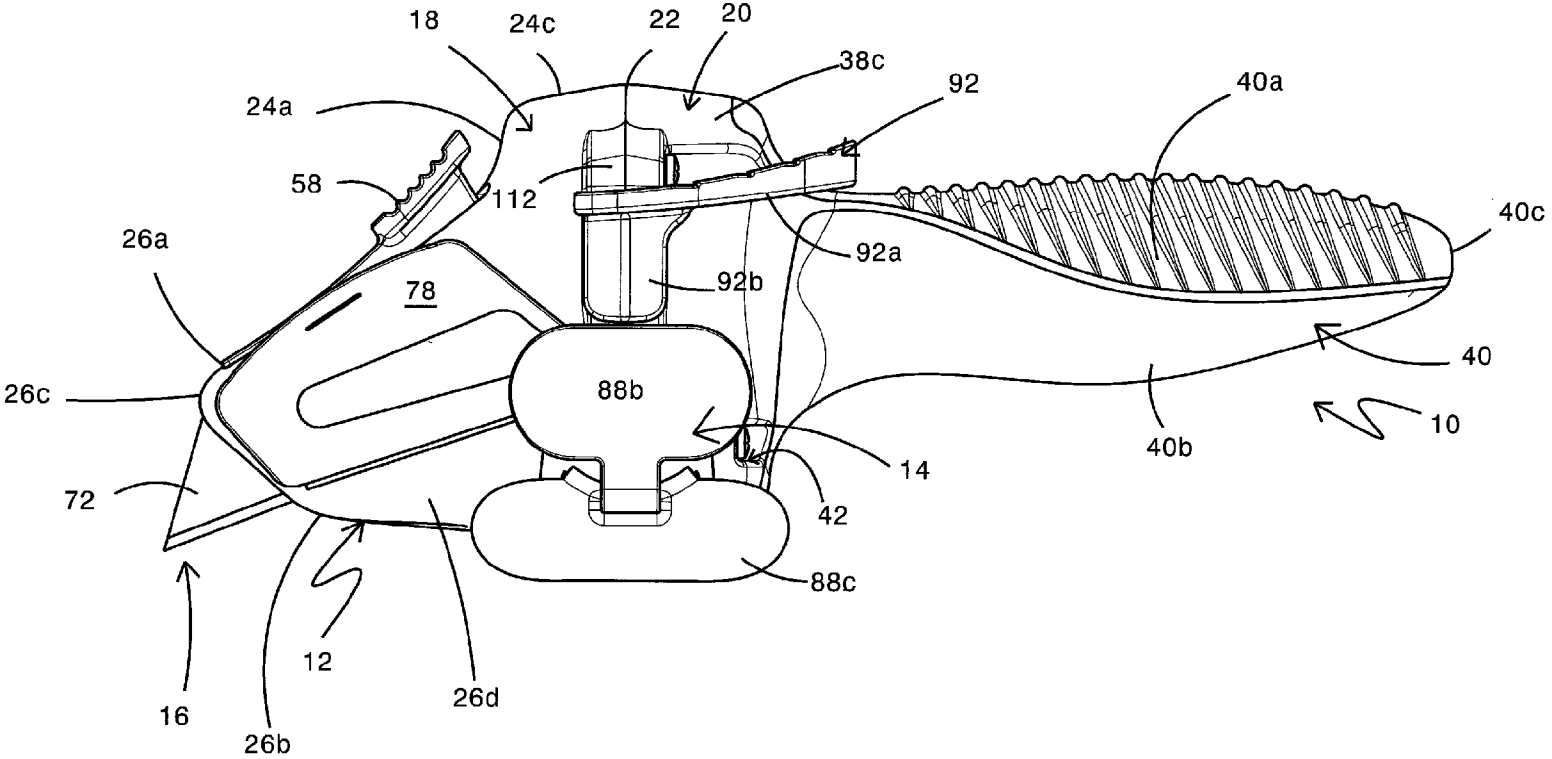
FIG. 3 is a left side view of the drywall tool of FIG. 2.

As indicated previously, rear housing section 20 also includes a handle 40 that extends outwardly from rear end 38*b* of second region 38. Handle 40 is ergonomically configured for use in either of a left hand or a right hand of an installer. As shown in FIG. 3, handle 40 has an upper surface 40*a*, a lower surface 40*b* and an end 40*c*. Upper surface 40*a* preferably is provided with a plurality of ridges 54 that extend at right angles to longitudinal axis "Y" (FIG. 4) of housing 12. Ridges 54 make it easier for the user to grip handle 40 and apply pressure to tool 10 during use thereof. The shape of handle 40 along with ridges 54 aid in ensuring that handle 40 does not rotate within the installer's hand during use of the device.

As indicated previously herein drywall tool 10 further includes knife assembly 16. Knife assembly 16 includes a blade support 56 that is configured to be received within the cavity of knife casing 26 of front housing section 18. Preferably, blade support 56 is die cast metal. Blade support 56 is generally V-shaped in order to be received within blade support 56. Blade support 56 has a top edge 56*a*, a bottom edge 56*b*, a front end 56*c*, a rear end 56*d*, a first side 56*e* and a second side 56*f*. Blade support 56 is configured to be operatively engaged by a knife lock 58. Knife lock 58 is a manually operable lever that is used to move blade support 56 within knife casing 26 and to lock the same in a particular orientation relative thereto. Preferably, knife lock 58 is die cast metal. Blade support 56 defines a through-hole 60 configured to receive a fastener 62 for securing blade support 56 to knife lock 58. Additionally, blade support 56 includes a first flange 64 and a second flange 65. First flange 64 is contacted by a spring 66 disposed about a post 68 on knife lock 58. Spring 66 biases knife lock 58 into a locked position. Knife lock 58 further includes a ridged seat 69 that is ergonomically designed to receive the installer's thumb thereon during operation of drywall tool 10.

Blade support 56 further includes a frame 70 for engaging a knife blade 72 therein. Preferably, frame 70 is comprises of a plurality of L-shaped flanges disposed on one of the first and second sides 56*e*, 56*f* of blade support 56. These flanges include a first leg that extends perpendicularly outwardly from the one of the sides 56*e*, 56*f* of blade support 56 and a second leg that is disposed substantially parallel to the sides 56*e*, 56*f* so that a small pocket is formed between the side and the second leg. Portions of blade 72 are received in this pocket.

Figure 7:
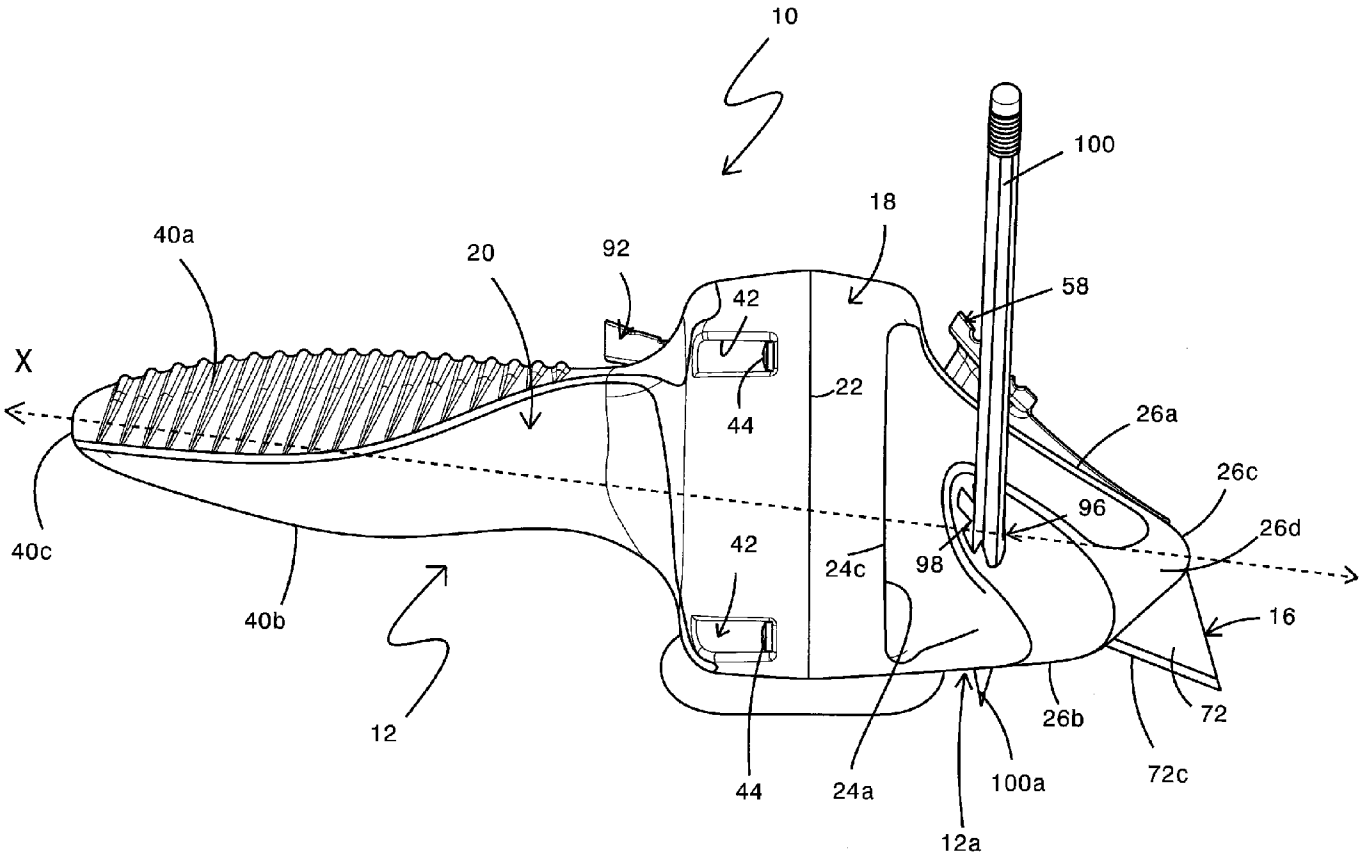
FIG. 7 is a right side view of the drywall tool showing a marking implement selectively engaged therewith.

As indicated above, knife assembly 16 further includes a plurality of blades 72. Preferably, blades 72 are two-ended utility-knife type blades but any other suitable blade may be used in drywall tool 10. Frame 70 is configured to receive an end region 72*a* of one of blades 72 therein and to retain the same adjacent the associated side 56*e*, 56*f* of blade support 56. Each blade 72 further includes a pair of notches 72*b* therein that are configured to engage flanges 74 on knife lock 58. Referring to FIG. 7 it should be noted that handle 40 has a centerline axis "X" as measured between its upper surface 40*a* and lower surface 40*b* and extending from its rear end 40*c* toward where it joins second region 38. Blade 72, and most particularly tip 73 of blade 72, extends for a short distance below bottom 12*a* of housing 12 and is positioned a short distance below that centerline "X" of handle.

Knife lock 58 is movable between a locked position and an unlocked position. In the locked position, a portion of the upper wall 58*a* of knife lock 58 is wedged within aperture 32 in knife casing 26 and contacts the underside of top 26*a* of knife casing 26. This wedging engagement substantially prevents movement of blade support 56 in a direction parallel to longitudinal axis "Y". When it is desired to move knife lock 58 from a locked position to an unlocked position, the installer places his thumb on a ridged seat 69 of knife lock 58 and depresses knife lock 58 inwardly in the direction of arrow "A" (FIG. 5)". The downward movement of knife lock 58 compresses spring 66 and frees upper wall 58*a* from its contact with the underside of top 26*a* of knife casing 26. Knife lock 58 pivots about fastener 62 during this movement. Knife lock 58 may then be moved in the direction of arrow "B" while downward pressure is maintained on seat 69. Knife lock thereby causes blade support 56 to be moved in the direction of arrow "B", thus causing at least a portion of blade 72 to be moved out of the second aperture in knife casing 26, bringing the cutting surface 72*c* on blade 72 into a position where it may be used to cut drywall, as will be hereinafter described. If the downward pressure on seat 69 is removed, spring 66 returns to its original position and moves knife lock 58 in a direction opposite to arrow "A", thereby locking blade support 56 and 72 in that location.

In accordance with yet another feature of the present invention, drywall tool 10 further includes a blade storage member 78 which is engaged with second side 26*f* of knife casing 26. Blade storage member 78 comprises a first and second wall 78*a*, 78*b* which bound and define a compartment 80 between them. First wall 78*a* preferably is fixedly secured to triangular member 26 and second wall 78*b* is hingedly secured to first wall 78*a* and is snap-locked thereto. Compartment 80 is configured to receive a plurality of spare blades 75 therein. FIG. 1 shows that blade storage member 78 defines a tapered aperture 81 in second walls 78*b* that permits the installer to see whether any spare blades 75 are inside storage member 78. Second wall 78*b* is flipped downwardly to access spare blades 75 and is flipped upwardly to reclose storage member 78. When it is necessary to replace blade 72, knife lock 58 is moved to an unlocked position as previously described and is then moved in the direction of arrow "B" (FIG. 5) to where blade 72 extends outwardly from knife casing 26 to a sufficient degree that it is able to be removed from knife casing 26. Storage member 78 is opened and one of the plurality of spare blades 75 is removed therefrom and is engaged with blade support 56. Blade support 56 is then withdrawn back into knife casing 26. It will be understood that any other suitable method of removing blade 72 from knife casing 26 may also be utilized without departing from the scope of the invention. For instance, front and rear housing sections may be disengaged from each other and blade support may be withdrawn from knife casing 26 and moved into chamber 28.

Figure 4:
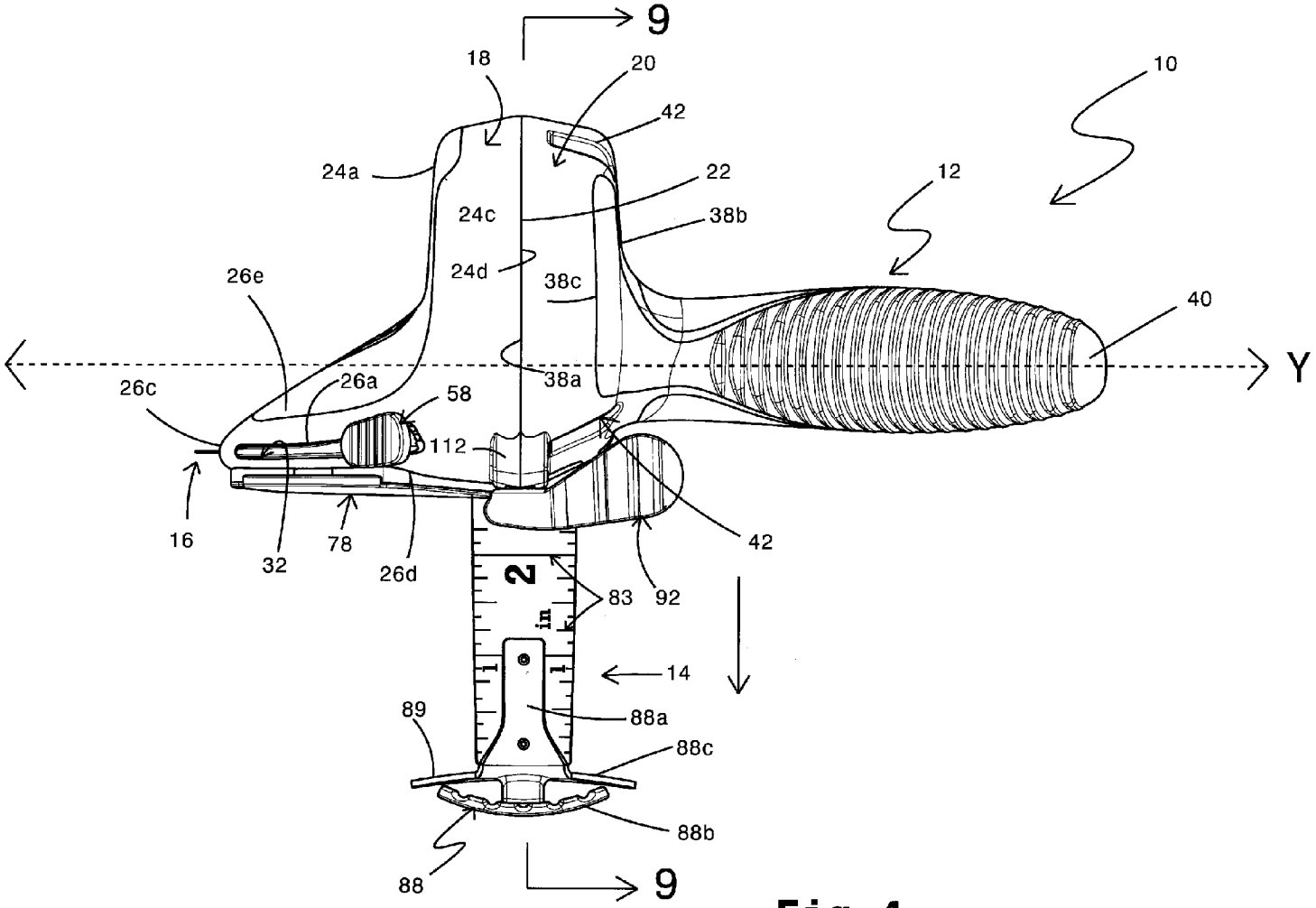
FIG. 4 is a top view thereof.

In accordance with yet another feature of the present invention, tape assembly 14 preferably is comprised of a spool 82 onto which a length of measuring tape 84 is wound. Preferably, both spool 82 and tape are comprised of metal but other suitable materials may be used instead. Spool 82 defines an aperture 86 therein that is complementary in size to receive axle 30 therethrough and spool 82 is configured to rotate about axle 30. Tape 84 has a first end (not shown) that is fixedly engaged with spool 82 and a second end 84*a* secured to a tape guide 88. Although not illustrated herein, it will be understood that spool 82 includes a spring mechanism which biases spool 82 in such a manner so as to cause tape 84 to be wound up onto spool 82 when it is not locked in position, as will be hereinafter described. Tape 84 further includes an upper surface 85 (FIG. 10) and a lower surface 87. As indicated previously, upper surface 87 may be provided with indicia 83 such as numbers or markings as is shown in FIG. 4. Tape 84 may, alternatively, be free of any markings and/or numbers, as shown in FIG. 1, as markings and/or numbers are not necessary to accomplish the method in which the present invention is used.

In accordance with a specific feature of the present invention, spool 82 and tape 84 are positioned within chamber 28 so that tape 84 exits housing 12 through slot 52 beneath panel 50. It should be noted that slot 52 is positioned so that tape 84 exits housing 12 at substantially 90° relative to the longitudinal axis "Y" (FIG. 4) of drywall tool 10. As indicated previously, panel 50 is manufactured from a clear plastic and this is so that the installer is able to see indicia 83, such as numbers or line markings on tape 84, if they are provided, before those indicia exit housing 12 through slot 52. Tape 84 is movable relative to housing 12 between an extended and a retracted position, as will be hereinafter described. Tape guide 88 cannot pass through slot 52 and it thereby prevents second end 84*a* of tape from being retracted through slot 52 and into the chamber 28 of housing 12. Tape guide 88 preferably is also die cast metal and comprises a Y-shaped foot 88*a*, an upstanding flange 88*b*, and a downwardly extending flange 88*c*. Foot 88*a* is fixedly secured to second end 84*a* of tape in such a manner that the straight stem of the Y-shaped foot 88*a* is positioned substantially parallel to the longitudinal axis of the tape 84. The flanges 88*b*, 88*c* are located beyond the edge of tape. Preferably, foot 88*a* is secured to second end 84*a* of tape 84 by rivets or some other suitable means. Upstanding flange 88*b* is disposed generally at right angles to foot 88*a* and extends for a distance upwardly beyond upper surface 85 of tape 84. Upstanding flange 88*b* preferably is gently convexly curved relative to housing 12, as is shown in FIG. 4, and includes a plurality of ribs 90 on an interior surface thereof. Ribs 90 are disposed opposite housing 12. The curvature of flange 88*b* and the ribs 90 provided thereon make it easier for an installer to grasp flange 88*b* by inserting a fingertip between flange 88*b* and housing 12.

Downwardly extending second flange 88*c* is also disposed generally at right angles to foot 88*a* and extends for a distance downwardly below bottom surface 87 of tape 84. Second flange 88*c* preferably is a large radius member that is configured to abut and travel along an edge of a piece of drywall, as will be described later herein. In particular, second flange 88*c* is configured to be complementary in shape to the radius of curvature of an edge of a drywall sheet, such as edge 104*a* of drywall sheet 104 shown in FIG. 13.

Figure 10:
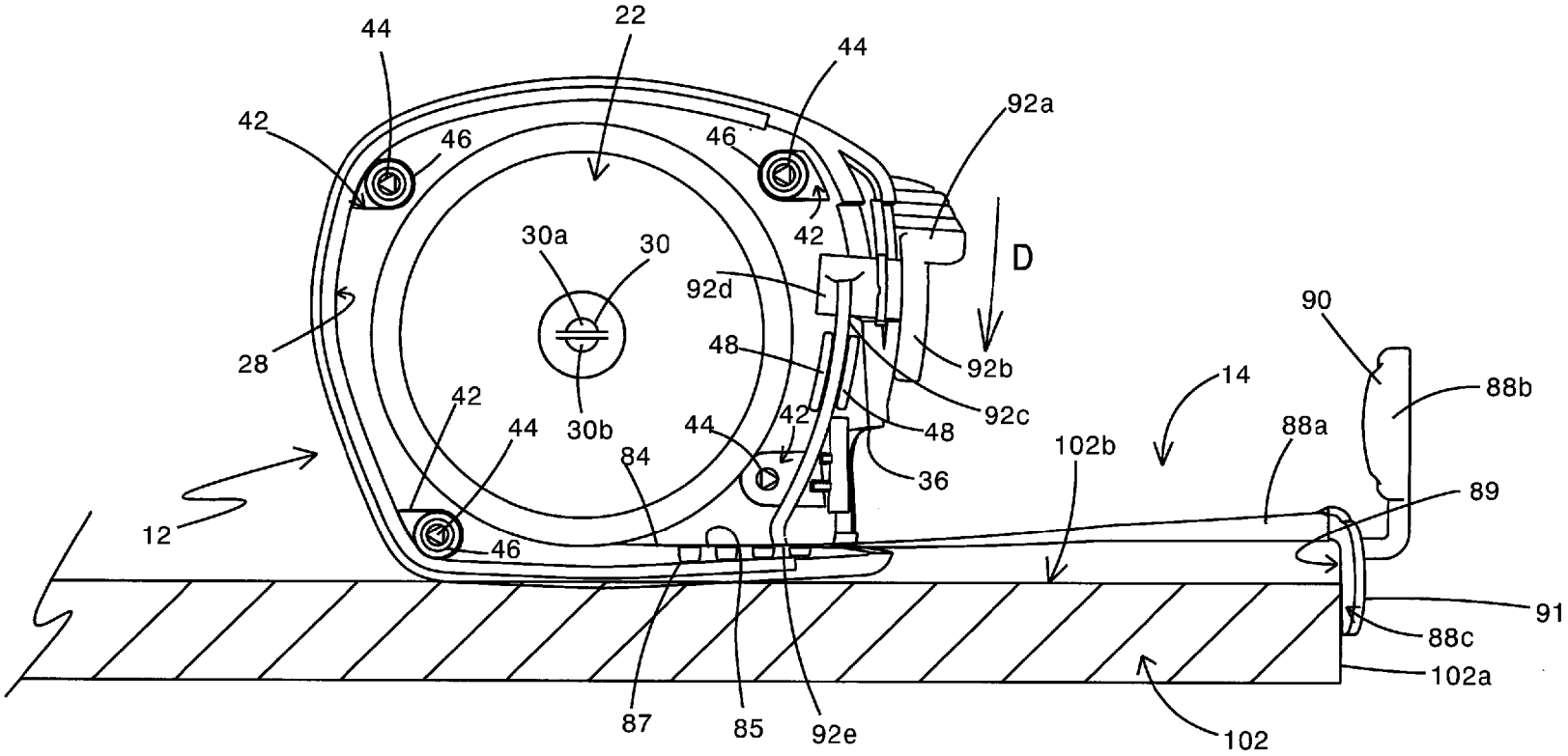
FIG. 10 is a cross-sectional front view of the tape dispenser showing the locking mechanism in an engaged position.

In accordance with yet another feature of the present invention, drywall tool 10 further includes a manually operable brake mechanism 92 that is mounted externally on housing 12. Particularly, brake mechanism 92 is configured to move up and down a curved detent 112 between an unlocked and a locked position. Detent 112 comprises a first part 112*a* provided on first region 24 and a second part 112*b* provided on second region 38. Brake mechanism 92 includes a finger tab 92*a* that is provided with a plurality of ridges 94 thereon. A flange 92*b* extends downwardly from finger tab 92*a* and generally at right angles thereto. A brake plate 92*c* is secured to flange 92*b* by a connector 92*d* and brake plate 92*c* and flange 92*b* are disposed substantially parallel to each other. Brake plate 92*c* terminates in an end 92*e* that is configured to engage upper surface 85 of tape 84 when brake mechanism 92 is engaged and to separate from upper surface 85 when brake mechanism 92 is released. As best shown in FIGS. 6, 9 and 10, brake plate 92*c* passes through gap 49 between flanges 48 which extend forwardly from rear housing section 20. Flanges 48 ensure that brake plate 92*c* is retained at all times in the correct orientation relative to tape 84.

Figure 8:
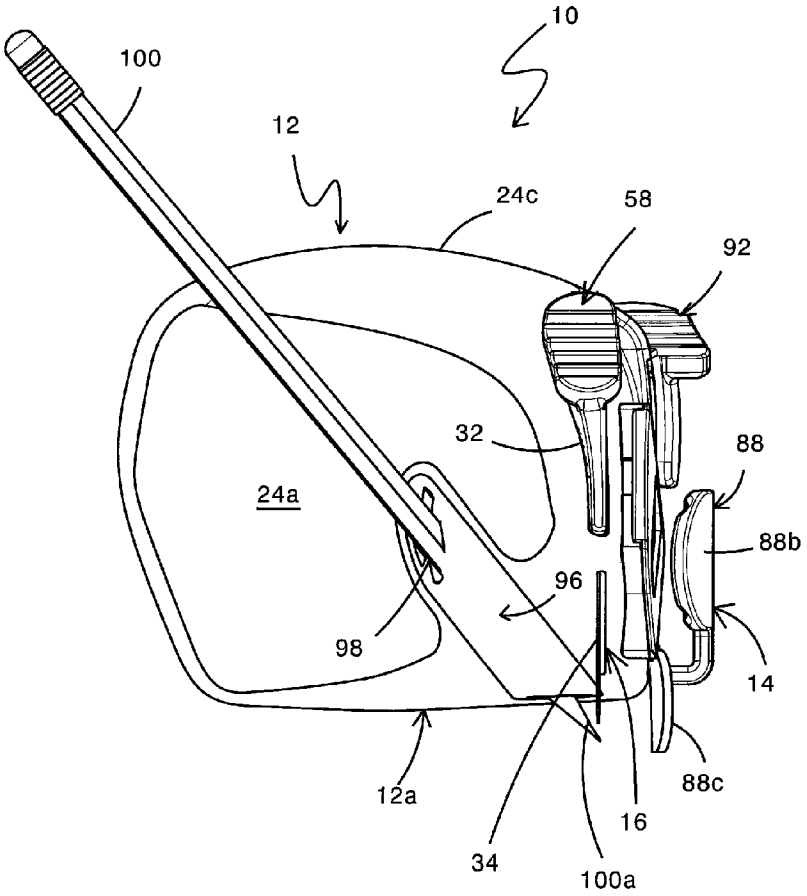
FIG. 8 is a front view of the drywall tool as shown in FIG. 7.

In accordance with yet another specific feature of the present invention, drywall tool 10 further includes a holder 96 for a marking implement (FIG. 5). Holder 96 preferably is manufactured from a flexible material, such as rubber, and is fixedly secured to first housing 18. In particular, holder 96 is positioned adjacent knife casing 26 and extends outwardly from front end 24*a* of first region 24. Holder 96 includes an aperture 98 that is configured to grippingly engage a marking implement 100 (FIG. 7) therein. Preferably, aperture 98 is substantially "star-shaped" so that marking implement 100 can be inserted therein and the flaps 99 (FIG. 5) will grippingly engage the side surfaces of marking implement 100. FIG. 8 shows that holder 96 is oriented so that when a marking implement 100 is engaged therein, the point 100*a* of marking implement 100 is substantially aligned with knife blade 72. This ensures that if marking implement 100 is used to mark a sheet of drywall, as will be described hereinafter, the point 100*a* will make a mark in substantially the same location as blade 72 will score or cut the drywall sheet.

Drywall tool 10 is used in the following manner. In its initial position, shown in FIG. 1, tape 84 is wound onto spool 82 and tape guide 88 is disposed adjacent the exterior surface of peripheral walls 24*c*, 38*c* of first and second regions 24, 38. The installer grasps tool 10 by way of handle 40 and will use their other hand to engage upstanding flange 88*b* of tape guide 88 and move flange 88*b* in the direction of arrow "C" (FIGS. 4 and 9) to extend a length of tape 84 outwardly from housing 12. Tape 84 is unwound from spool 82 until the desired length of tape 84 extends outwardly beyond peripheral walls 24*c*/38*c*. It should be noted that tape 84 may only be unwound from spool 82 when brake mechanism 92 is in the disengaged position shown in FIG. 9.

Once the desired length of tape 84 has been dispensed from spool 82, the installer will move brake mechanism 92 to the engaged position by depressing it downwardly in the direction of arrow "D" (FIG. 10). This movement causes flange 92*b* to ride along detent 112 and causes end 92*e* of brake plate 92*c* to come into contact with upper surface 85 of tape 84. This contact prevents further movement of tape 84 in either the direction of arrow "C" or in the opposite direction to arrow "C". In other words the length of tape 84 extending outwardly from housing 12 remains constant. Obviously, if it is desired to wind some of the tape 84 back onto spool 82, i.e., to move tape 84 to a retracted position, then brake mechanism 92 is disengaged and the tape 84 will then automatically rewind onto spool 82 because of the spring mechanism (not shown) associated therewith. Brake mechanism 92 also has to be disengaged to increase the length of tape 84 extending outwardly from housing 12. Brake mechanism may be disengaged by any suitable means such as by the inclusion of a spring mechanism to return the brake mechanism 92 to its original position. Alternatively, brake mechanism 92 may be moved back to its original position by simply pulling it upwardly.

It should be noted from FIGS. 9 and 10 that brake plate 92*c* has a first region proximate connector 92*d* that curves in a first direction and a second region proximate end 92*e* that curves in an opposite direction. The specific curvature of brake plate 92*a* and the orientation of the flanges 48 relative thereto substantially prevent brake mechanism 92 from accidentally disengaging. It will be understood that other or additional locking mechanisms may be provided on brake mechanism 92 to keep it in the engaged position or in the disengaged position.

Drywall tool 10 may now be used for three different types of operations. Firstly, tool 10 may be used to measure a gap 103 between two spaced apart drywall sheets such as sheets 101 and 102 shown in FIGS. 11 and 12 in order to prepare a panel to fit into that gap 103. Secondly, drywall tool 10 may be used to make a line on a drywall sheet. Thirdly, drywall tool 10 may be used to score or cut a drywall sheet.

Figure 11:
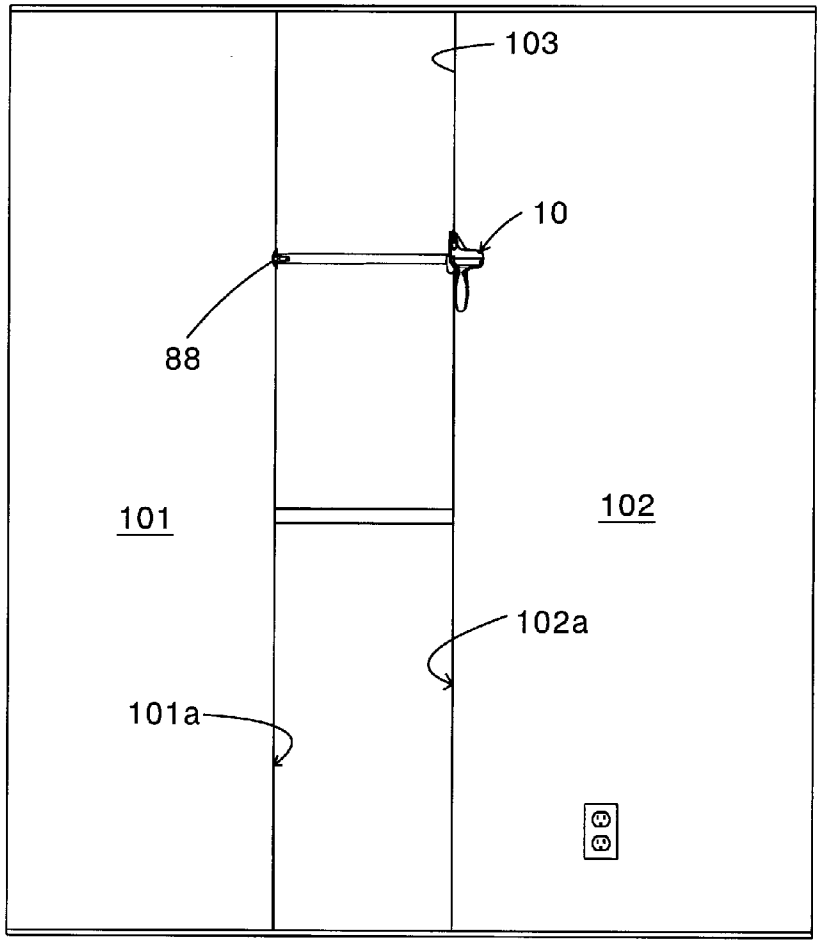
FIG. 11 is a front elevational view of a vertically-oriented drywall panel and showing the drywall tool in accordance with the present invention engaged therewith.
Figure 12:
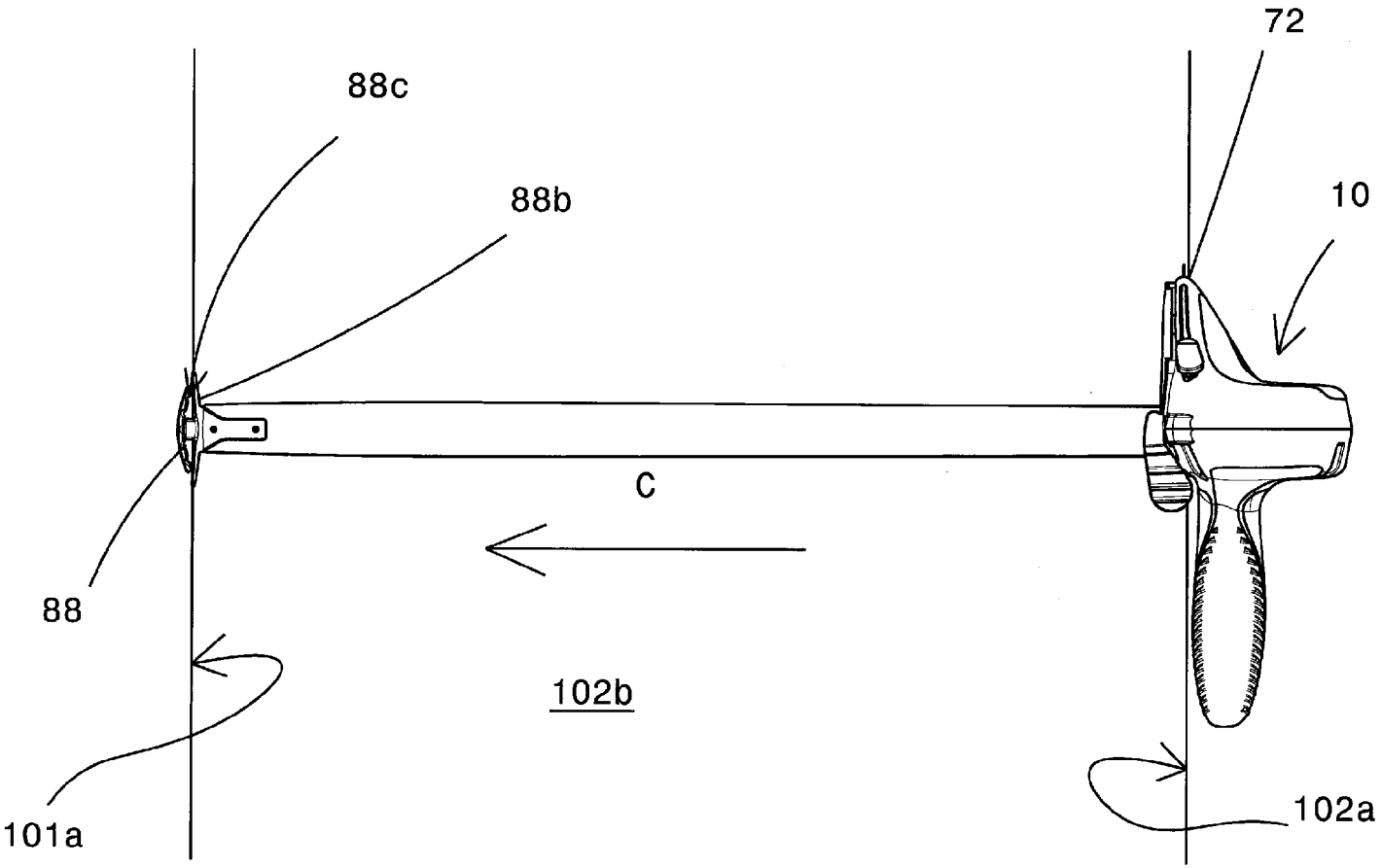
FIG. 12 is a partial enlargement of a front elevational view of the drywall tool engaged with the vertically-oriented drywall panel as shown in FIG. 10.

FIGS. 11 and 12 show a first drywall sheet 101 and a second drywall sheet 102 separated from each other by gap 103 of an unknown size, where the gap is defined as the space between edges 101*a* and 102*a*. In order to measure gap 103 to cut a panel to fill the same, the exterior surface 91 of second flange 88*c* of tape guide 88 is placed adjacent edge 101*a* of first panel 101 and is held in that location. Handle 40 is pulled away from tape guide 88 in the direction opposite to arrow "C" (FIG. 9) to extend a length of tape 84 out of drywall tool 10. When the correct length of tape 84 is reached, i.e., when knife blade 72 is disposed substantially in alignment with edge 102*a*, brake mechanism 92 is engaged. The desired locked length of tape 84 then extends outwardly from housing 12. The installer can then move the locked drywall tool 10 to a third drywall sheet 104 (FIG. 13) and either mark the appropriate size for the panel on the exterior surface of sheet 104 or, immediately score (i.e., cut) third drywall sheet 104 as will be described hereafter. The installer does not need to know the size of the actual opening as the actual size is locked into the arrangement of the extended tape 84 relative to housing 12. The installer simply needs to use the locked body/tape arrangement 12/84 to mark or score the drywall sheet 104.

Figure 13:
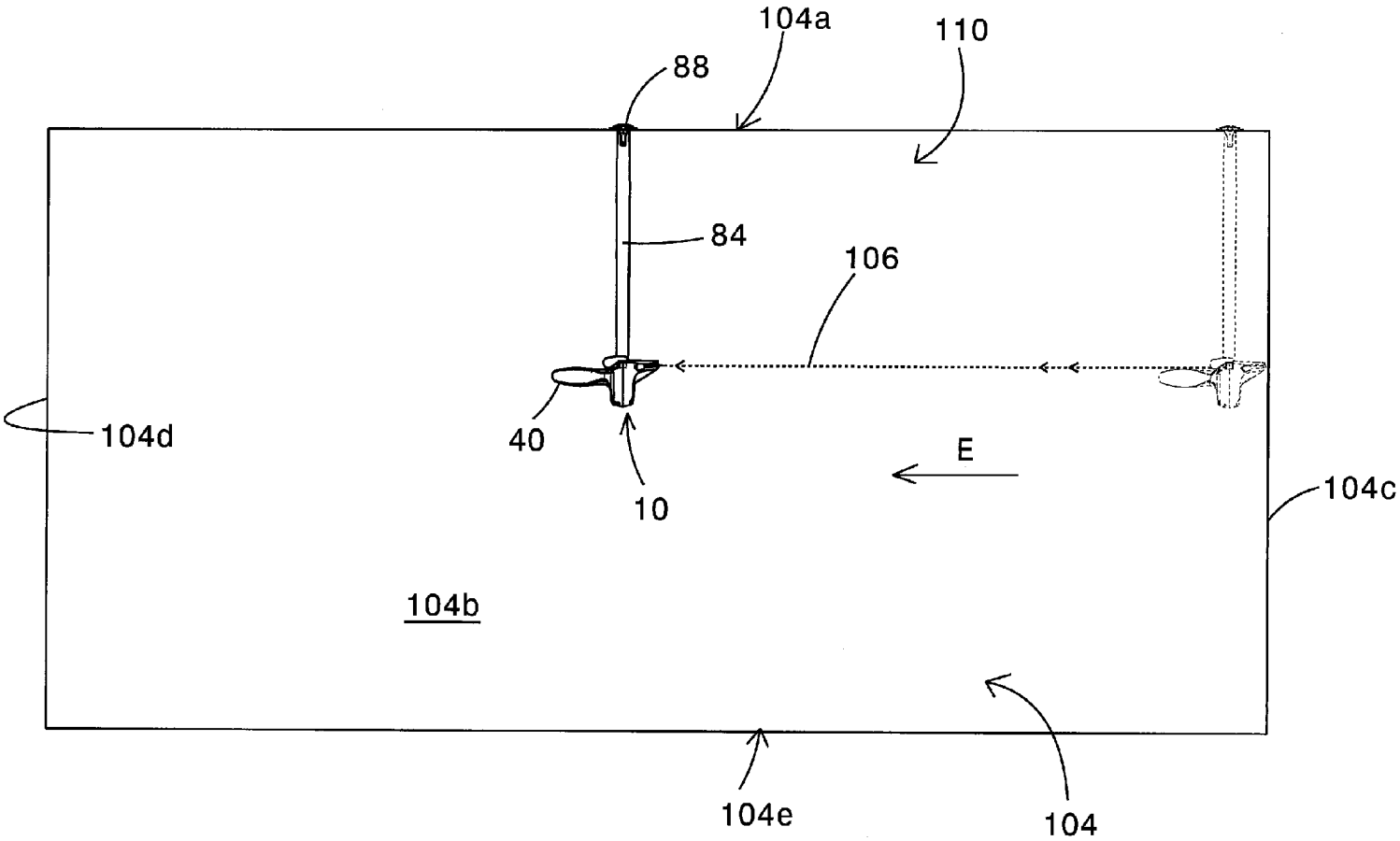
FIG. 13 is a front elevational view of a horizontally-oriented drywall panel showing the drywall tool in accordance with the present invention engaged therewith and showing a score line on the panel between a first and second position of the drywall tool.

In order to do this, and as shown in FIG. 13, tape guide 88 is engaged with one of the edges 104*a*, 104*c*, 104*d*, and 104*e* of drywall sheet 104. In this instance, tape guide 88 is engaged with edge 104*a*. This engagement is accomplished by placing interior surface 89 of tape guide flange 88*c* in abutting contact with edge 104*a*. In a marking operation, a marking implement 100 is inserted into hole 98 in holder 96 so that the point 100*a* thereof is substantially aligned or extends slightly beyond bottom 12*a* of housing 12. Point 100*a* thereof is also substantially aligned with blade 72 and is positioned slightly forwardly of blade 72 (FIG. 8). Bottom 12*a* of housing 12 is placed in abutting contact with exterior surface 104*b* of drywall sheet 102 and starting proximate a first end of sheet 104, tool 10 is moved in the direction of arrow "E" while pushing tool 10 firmly against exterior surface 104*b* of drywall sheet 104. Bottom 12*a* of housing 12 is kept in contact with sheet 104 from proximate the first end 104*c* thereof to proximate the second end 104*d* thereof. As housing 12 moves over exterior surface 104*b*, tape guide 88 slides along edge 104*a* while the point 100*a* of marking implement 100 simultaneously contacts the exterior surface 104*b* and draws a line 106 thereon. Later, the installer may utilize a separate utility knife, for example, to score drywall sheet 104 along line 106 and then snap the desired panel 110 so formed from the rest of sheet 104.

Alternatively, the marking implement may be omitted from drywall tool 10 and blade 72 can be extended outwardly from knife casing 26 by moving knife lock 58 to a disengaged position, as previously described. Tape guide 88 is then engaged with edge 104*a* of drywall sheet by positioning interior surface 89 of flange 88*c* in abutting contact with edge 104*a*. Bottom 12*a* of housing 12 is placed in abutting contact with exterior surface 104*b* of drywall sheet and handle 40 of housing 12 is rotated slightly upwardly away from exterior surface 104*b*, thereby causing tip 73 (FIG. 5) of blade 72 to bite into exterior surface 104*b*. Housing 12 is then moved across exterior surface 104*b* from first edge 104*c* to second edge 104*d* in the direction of arrow "E", keeping bottom 12*a* and blade tip 73 in contact with exterior surface 104*b* and continuously applying substantially even pressure on tool 10 in a direction toward exterior surface 104*b*. Tape guide 88 is simultaneously kept in engagement with edge 104*a* of drywall sheet 104 as housing 12 is moved in the direction of arrow "E". Thus, the distance between edge 104*a* and the score line 106 made by knife blade 72 is kept substantially constant. During this entire operation, the installer will keep his or her thumb in contact with seat 69 of knife lock 58 to keep blade 72 extended from tool 10 and to apply substantially constant pressure on blade tip 73. At any point during this scoring operation the installer is able lift his thumb off seat 69 and blade lock 58 will engage. Drywall tool 10 may be completely disengaged from drywall sheet 104. Then, when the installer wishes to resume scoring sheet 104, he or she simply engages tape guide 88 with edge 104*a* again, disengages knife lock 58 and continues scoring sheet 104. Since the tape 84 remains locked in position relative to tape guide 88, no adjustments need to be made to guide 88 and the device can be used to complete score line 106. Once drywall sheet 104 has been scored for the desired distance, the so-formed panel 110 is detached to separate it from sheet 104 in the known manner, i.e., by snapping the panel 110 and sheet 104 apart.

It will, of course, be understood that the measuring, marking and scoring operations may be performed on either of a vertical or a horizontally oriented drywall sheet without departing from the scope of the present invention.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A tool for use when installing drywall sheets, said tool comprising:

a housing having a front end, a rear end and a longitudinal axis intersecting the front and rear ends;

a spool rotatably mounted on the housing;

a flexible reusable measuring tape windable on the spool and being selectively extendable and retractable therefrom relative to a side wall of the housing and perpendicular to the longitudinal axis, said tape having a second end;

a guide mounted on the second end of the tape, said guide being oriented substantially parallel to the longitudinal axis of the housing;

a first contact device provided on the housing suitable for selectively scoring an exterior surface of the sheet as the tape guide is moved along an edge of the sheet in a direction parallel to the longitudinal axis of the housing; wherein the first contact device comprises a knife blade that is oriented substantially parallel to the longitudinal axis of the housing and to the guide; and the knife blade extends forwardly and outwardly beyond the front end of the housing;

a second contact device provided on the housing suitable for selectively marking the exterior surface of the sheet; said second contact device comprising:

a marking implement having a point suitable for marking on the surface of the sheet, and wherein the marking implement is positioned such that the point thereof is aligned with the knife blade and is positioned outwardly in front of the front end of the housing and in front of the knife blade;

wherein the tape guide includes:

a foot fixedly secured to the second end of the tape;

a first flange disposed at right angles to the foot; and extending outwardly from the foot in a first direction; said first flange being adapted to be engaged by an installer to extend the tape outwardly from the housing; and wherein the first flange has an interior surface facing toward the housing and an outer surface facing away from the housing; and wherein the interior surface is convex when viewed from above and bulges away from the housing; and a second flange disposed at right angles to the foot and extending outwardly from the foot in a second direction; said second flange being configured to be complementary to an edge of the drywall sheet.

2. The tool defined in claim 1 wherein the first contact device includes a knife casing and the knife blade is retractably mounted in the casing and is selectively extendable therefrom for scoring the sheet.

3. The tool defined in claim 2 wherein the first contact device further includes an adjustment device operatively connected to the knife blade for adjusting the amount of extension of the knife blade from the casing.

4. The tool defined in claim 3 wherein the adjustment device includes a manually operated lever mounted on the housing and the lever is movable between an engaged and disengaged position, and when the lever is in the engaged position, the blade is locked against movement relative to the knife casing; and when the lever is in the disengaged position, the blade is free to move relative to the knife casing.

5. The tool defined in claim 2 wherein the knife blade is detachably engaged with the knife casing.

6. The tool as defined in claim 2, wherein the housing further includes a handle which extends outwardly therefrom and is adapted to be held by the installer; and wherein the handle has a centerline axis and wherein the tip of the knife blade is disposed a spaced distance below a bottom wall of the housing and proximate the centerline axis thereof.

7. The tool defined in claim 1, wherein the second contact device includes a holder for retaining the marking implement therein, wherein the holder is provided on the housing.

8. The tool as defined in claim 1, wherein a plurality of ribs are provided on the interior surface of the first flange.

9. The tool as defined in claim 1 wherein the housing further includes a handle that is aligned along the longitudinal axis of the tool; and wherein the handle extends outwardly from the housing and is adapted to be held by the installer; and wherein the housing defines a slot through which the tape extends, and wherein the slot is located so that the tape extends outwardly from the housing substantially at right angles to the longitudinal axis.

10. The tool as defined in claim 1, wherein the flexible tape is one of provided with indicia thereon or is free of indicia.

11. The tool as defined in claim 1, further comprising:

a brake mechanism mounted on the housing and operatively engageable to maintain the tape in an extended position relative to the side wall of the housing.

12. The tool defined in claim 11, wherein the brake mechanism includes a manually operated lever mounted externally on the housing.

13. The tool defined in claim 12 wherein the brake mechanism further includes:

a seat adapted to be depressed by the installer; said seat being disposed adjacent an exterior surface of the housing;

a brake plate operatively engaged with the seat; said brake plate being disposed within an interior chamber of the housing; and wherein the brake plate has an end configured to engage a surface of the tape.

14. The tool defined in claim 13 wherein the end of the brake plate is movable toward the surface of the tape and into contact with the same when the brake mechanism is engaged; and the end is movable away from the surface of the tape when the brake mechanism is disengaged.

15. The tool as defined in claim 1, wherein the housing defines an internal chamber and the spool is positioned within the internal chamber.

16. A tool for use when installing drywall sheets, said tool comprising:

a housing having a front end, a rear end and a longitudinal axis intersecting the front and rear ends;

a spool rotatably mounted on the housing;

a flexible reusable measuring tape windable on the spool and being selectively extendable and retractable therefrom relative to a side wall of the housing and perpendicular to the longitudinal axis, said tape having a second end;

a guide mounted on the second end of the tape, said guide being oriented substantially parallel to the longitudinal axis of the housing;

a first contact device provided on the housing suitable for selectively scoring an exterior surface of the sheet as the tape guide is moved along an edge of the sheet in a direction parallel to the longitudinal axis of the housing; wherein the first contact device comprises a knife blade that is oriented substantially parallel to the longitudinal axis of the housing and to the guide; and the knife blade extends forwardly and outwardly beyond the front end of the housing;

a second contact device provided on the housing suitable for selectively marking the exterior surface of the sheet; said second contact device comprising:

a marking implement having a point suitable for marking on the surface of the sheet, and wherein the marking implement is positioned such that the point thereof is aligned with the knife blade and is positioned outwardly in front of the front end of the housing and in front of the knife blade;

a storage member;

a compartment defined within the storage member; and one or more spare knife blades, wherein the storage member is secured to an exterior surface of the housing and the one or more spare knife blades are receivable within the compartment of the storage member;

wherein the storage member has a first wall and a second wall that are hingedly engaged with each other; and wherein the first wall is secured to the exterior surface of the housing and the second wall pivots relative to the first wall to enable access to the one or more spare knife blades.

17. The tool defined in claim 16, wherein the first contact device includes a knife casing and the knife blade is retractably mounted in the casing and is selectively extendable therefrom for scoring the sheet.

18. The tool defined in claim 17, wherein the first contact device further includes an adjustment device operatively connected to the knife blade for adjusting the amount of extension of the knife blade from the casing.

19. The tool defined in claim 18, wherein the adjustment device includes a manually operated lever mounted on the housing and the lever is movable between an engaged and disengaged position, and when the lever is in the engaged position, the blade is locked against movement relative to the knife casing; and when the lever is in the disengaged position, the blade is free to move relative to the knife casing.

20. The tool defined in claim 17, wherein the knife blade is detachably engaged with the knife casing.

21. The tool defined in claim 16, wherein the second contact device includes a holder for retaining the marking implement therein, wherein the holder is provided on the housing.

22. The tool defined in claim 16, wherein the brake mechanism includes a manually operated lever mounted externally on the housing.

23. The tool defined in claim 22, wherein the brake mechanism further includes:

a seat adapted to be depressed by the installer; said seat being disposed adjacent an exterior surface of the housing;

a brake plate operatively engaged with the seat; said brake plate being disposed within an interior chamber of the housing; and wherein the brake plate has an end configured to engage a surface of the tape.

24. The tool defined in claim 23, wherein the end of the brake plate is movable toward the surface of the tape and into contact with the same when the brake mechanism is engaged; and the end is movable away from the surface of the tape when the brake mechanism is disengaged.

25. The tool as defined in claim 11, wherein the housing further includes a handle that is aligned along the longitudinal axis of the tool; and wherein the handle extends outwardly from the housing and is adapted to be held by the installer; and wherein the housing defines a slot through which the tape extends, and wherein the slot is located so that the tape extends outwardly from the housing substantially at right angles to the longitudinal axis.

26. The tool as defined in claim 16, wherein the housing further includes a handle which extends outwardly therefrom and is adapted to be held by the installer; and wherein the handle has a centerline axis and wherein the tip of the knife blade is disposed a spaced distance below a bottom wall of the housing and proximate the centerline axis thereof.

27. The tool as defined in claim 16, wherein the flexible tape is one of provided with indicia thereon or is free of indicia.

28. A method of using a drywall tool for measuring an opening to be filled with a sheet of drywall and scoring the sheet of drywall to match the opening with said tool, said method including steps of:

providing the drywall tool defined in claim 11;

placing the guide on one edge of the opening;

retaining the tape guide against the edge;

moving the tool at right angles to the tool's longitudinal axis so that the point of the marker or the knife blade aligns with an opposite edge of the opening;

drawing a length of the tape off the spool and outwardly from the side wall of the housing as the tool is moved;

engaging a brake mechanism on the tool to lock the tape against further movement relative to the spool;

placing the tape guide in abutting contact with an edge of the sheet of drywall such that the tape guide is oriented parallel to the edge of the sheet and the drawn length of tape is in abutting contact with an exterior surface of the sheet of drywall;

placing the blade against the exterior surface of the sheet of drywall so that the length of the tape extends between the edge of the sheet and the blade;

moving the tool parallel to the edge of the sheet and therefore parallel to the longitudinal axis of the tool and across the exterior surface of the sheet;

scoring the exterior surface of the sheet with the blade along a line parallel to the edge of the sheet; and maintaining the tape guide against the edge of the sheet during the scoring operation.

29. The method as defined in claim 28 further including the steps of:

disengaging the tape guide from the edge of the sheet; and breaking the sheet along the score line.

30. The method as defined in claim 28 wherein the step of scoring the exterior surface of the sheet is preceded by marking the sheet with the point of the marker as the edge of the tape guide is maintained along the edge of the sheet and while the tool is moved parallel to the edge across the exterior surface of the sheet; and then extending the knife blade from a retracted position where the blade is located a distance from the exterior surface of the sheet and into an extended position wherein at least the tip of the blade contacts the exterior surface.

* * * * *